US005884756A

United States Patent [19]

Holley, Jr. et al.

[11] Patent Number: 5,884,756

[45] Date of Patent: Mar. 23, 1999

[54] BASKET-STYLE CARRIER

[75] Inventors: John M. Holley, Jr., Lawrenceville; Thomas A. Boshinski, Alpharetta, both of Ga.

[73] Assignee: The Mead Corporation, Dayton, Ohio

[21] Appl. No.: 11,194

[22] PCT Filed: Jul. 22, 1996

[86] PCT No.: PCT/US96/12092

§ 371 Date: Apr. 17, 1998

§ 102(e) Date: Apr. 17, 1998

[87] PCT Pub. No.: WO97/05026

PCT Pub. Date: Feb. 13, 1997

[51] Int. Cl.[6] ..... B65D 5/48; B65D 75/00

[52] U.S. Cl. ..... 206/144; 206/173; 206/193

[58] Field of Search ..... 206/139, 144, 206/147, 170–175, 187, 193–200, 427

[56] References Cited

U.S. PATENT DOCUMENTS

| | | |
|---|---|---|
| 3,784,053 | 1/1974 | Stout . |
| 4,146,129 | 3/1979 | Wood . |
| 4,171,046 | 10/1979 | Bonczyk . |
| 4,240,545 | 12/1980 | Stout . |
| 4,253,564 | 3/1981 | Engdahl, Jr. . |
| 4,286,709 | 9/1981 | Manizza . |
| 4,349,103 | 9/1982 | Wood . |
| 4,927,009 | 5/1990 | Stout . |
| 4,989,779 | 2/1991 | Lashyro . |
| 5,579,904 | 12/1996 | Holley, Jr. . |
| 5,611,425 | 3/1997 | Holley, Jr. . |

*Primary Examiner*—Paul T. Sewell
*Assistant Examiner*—Luan K. Bui
*Attorney, Agent, or Firm*—Thomas A. Boshinski

[57] ABSTRACT

A carrier for a plurality of objects arranged in four rows includes substantially parallel first and second side walls, substantially parallel first and second end walls interconnecting the side walls, a medial panel extending between the first and second end walls, the medial panel being disposed between and substantially parallel to the first and second side walls, first primary partition structure extending between the first and second end walls, the first primary partition structure being disposed between and substantially parallel to the first side wall and the medial panel, second primary partition structure extending between the first and second end walls, the second primary partition structure being disposed between and substantially parallel to said second side wall and the medial panel, a primary bottom wall connected between lower portions of the first and second side walls, and a secondary bottom wall connected between lower portions of the first and second primary partition structure.

4 Claims, 8 Drawing Sheets

BASKET-STYLE CARRIER

This is a continuation of International Application Serial Number WO 97/05026, which is a continuation-in-part of U.S. application Ser. No. 08/508,767 filed Jul. 28, 1995, now abandoned.

BACKGROUND OF THE INVENTION

The present invention relates generally to paperboard carriers for articles such as beverage bottles. More particularly, it relates to a basket-style carrier in which the articles are arranged in four parallel rows.

One traditional paperboard carrier for articles such as beverage bottles is the basket-style carrier. An example of such a carrier is shown in U.S. Pat. No. 4,927,009. The carrier includes side, end and bottom walls, and is typically used with articles grouped in two rows. Located between the two rows is a medial panel which connects the end walls and includes an opening to provide a handle by which the basket may be carried. In its usual form, this carrier also includes partition panels extending between the medial panel and the side walls, to define individual cells into which the articles may be placed.

Basket-style carriers are normally manufactured and shipped in a glued but collapsed condition. The end walls are folded at the medial panel, so that they are collapsed onto themselves to bring the side walls together. The medial panel is thus displaced longitudinally with respect to the side walls. For use, such as at a beverage bottling facility, the basket is erected by moving the medial panel back into alignment with the side walls. The end walls are brought into an unfolded position, and the set-up basket is available to be loaded with the articles to be carried.

Attempts have been made to develop basket-style carriers for larger multiples of articles arranged in more than two rows. For example, in a carrier for twelve beverage bottles, the articles may be arranged in four rows, two rows located on each side of the handle. However, the large size of such a carrier and the complex structure required for the partitions make it difficult to design such a carrier in which the normal folding from collapsed to erected condition can be carried out. In addition, the length of the required bottom wall makes it difficult to provide a bottom wall with sufficient rigidity to support the weight of four rows of articles.

One example of a basket carrier for articles arranged in four rows can be seen in U.S. Pat. No. 4,146,129. The carrier disclosed therein satisfies the strength requirements of the bottom carrier panel, since the bottom wall is connected to both side walls and both end walls by either fold lines or secured glue flaps. However, this carton construction is disadvantageous in that it requires special equipment to set up and glue the article carrier at the appropriate time. It is not possible to completely preglue and then collapse the carrier as with a conventional basket carrier, since the bottom panel when the carrier is completed is attached on all four sides.

Accordingly, a need exists for a basket-style carrier which can be erected from a collapsed condition using conventional techniques that is capable of carrying articles arranged in four rows.

SUMMARY OF THE INVENTION

Accordingly, the present invention provides a carrier for a plurality of objects arranged in four rows, wherein two bottom walls are provided for the carrier. A primary bottom wall is connected so as to extend beneath all four rows of the articles contained within the carrier, while a secondary bottom wall extends beneath only the two inner rows of the four article rows.

In accordance with one form of the invention, the carrier includes substantially parallel first and second side walls, and substantially parallel first and second end walls interconnecting the side walls. A medial panel extends between and connects the first and second end walls, the medial panel being disposed between and substantially parallel to the first and second side walls. A first primary partition structure extends between and is connected to the first and second end walls, the first primary partition structure being disposed between and substantially parallel to the first side wall and the medial panel. A second primary partition structure extends between and is connected to the first and second end walls, the second primary partition structure being disposed between and substantially parallel to the second side wall and the medial panel. A primary bottom wall is connected to and extends between the lower portions of the first and second side walls. A second bottom wall connects and extends between the lower portions of the first and second primary partition structures.

The carrier may further include secondary partition structure extending between and connected to the first side wall and the first primary partition structure, the first primary partition structure and the medial panel, the medial panel and the second primary partition structure, and the second primary partition structure and the second side wall to define therewith a plurality of cells for receiving the objects.

The first and second bottom walls may be disposed in substantially face-to-face contact.

DETAILED DESCRIPTION OF THE PREFERRED EMBODIMENT

Figure 1:
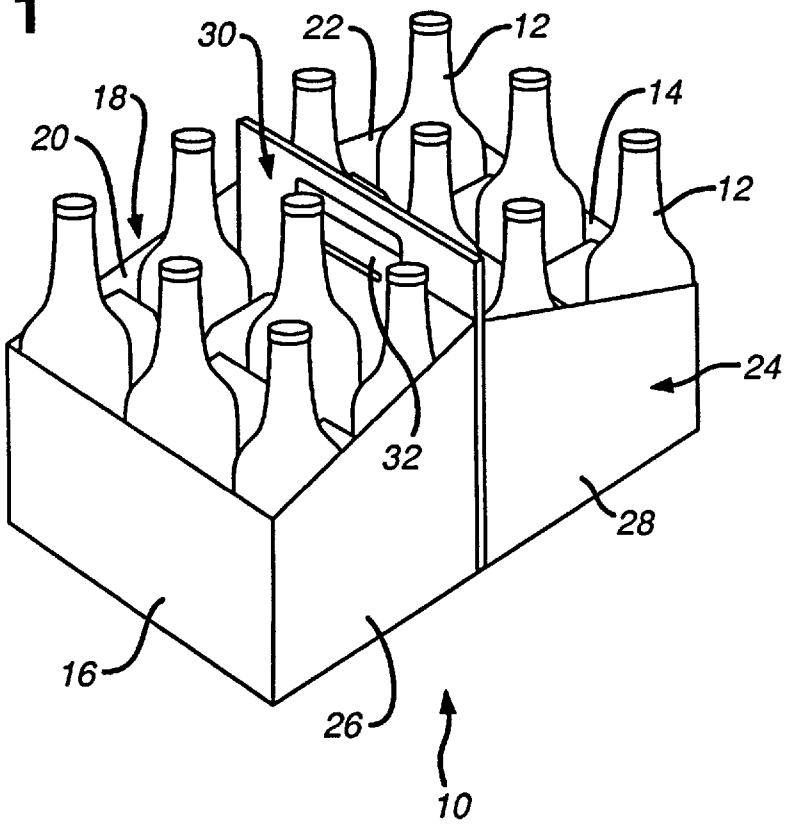
FIG. 1 is a perspective view of a carrier in accordance with a preferred embodiment of the present invention, showing the carrier in set-up condition and with beverage bottles loaded therein.

Referring generally now to FIG. 1, the present invention provides an article carrier 10 for carrying articles such as beverage bottles 12. While the carrier 10 is described therein generally in connection with the carrying of beverage bottles 12, it will be recognized that the carrier is suitable for the carrying of other products, such as non-beverage products packaged in bottles, beverage and non-beverage products packaged in cans, and other liquid and non-liquid products.

The carrier 10 includes a first side wall 14 and a second side wall 16. Connecting the side walls are a first end panel 18, formed of end panel 20 and end panel 22, and second end wall 24, formed of end panels 26 and 28. Extending between end walls 18 and 24, disposed between the second and third rows of bottles 12, is a medial panel 30. Medial panel 30 is provided near its upper end with an opening 32 that provides a handle by which the carrier 10 may be lifted.

Figure 2:
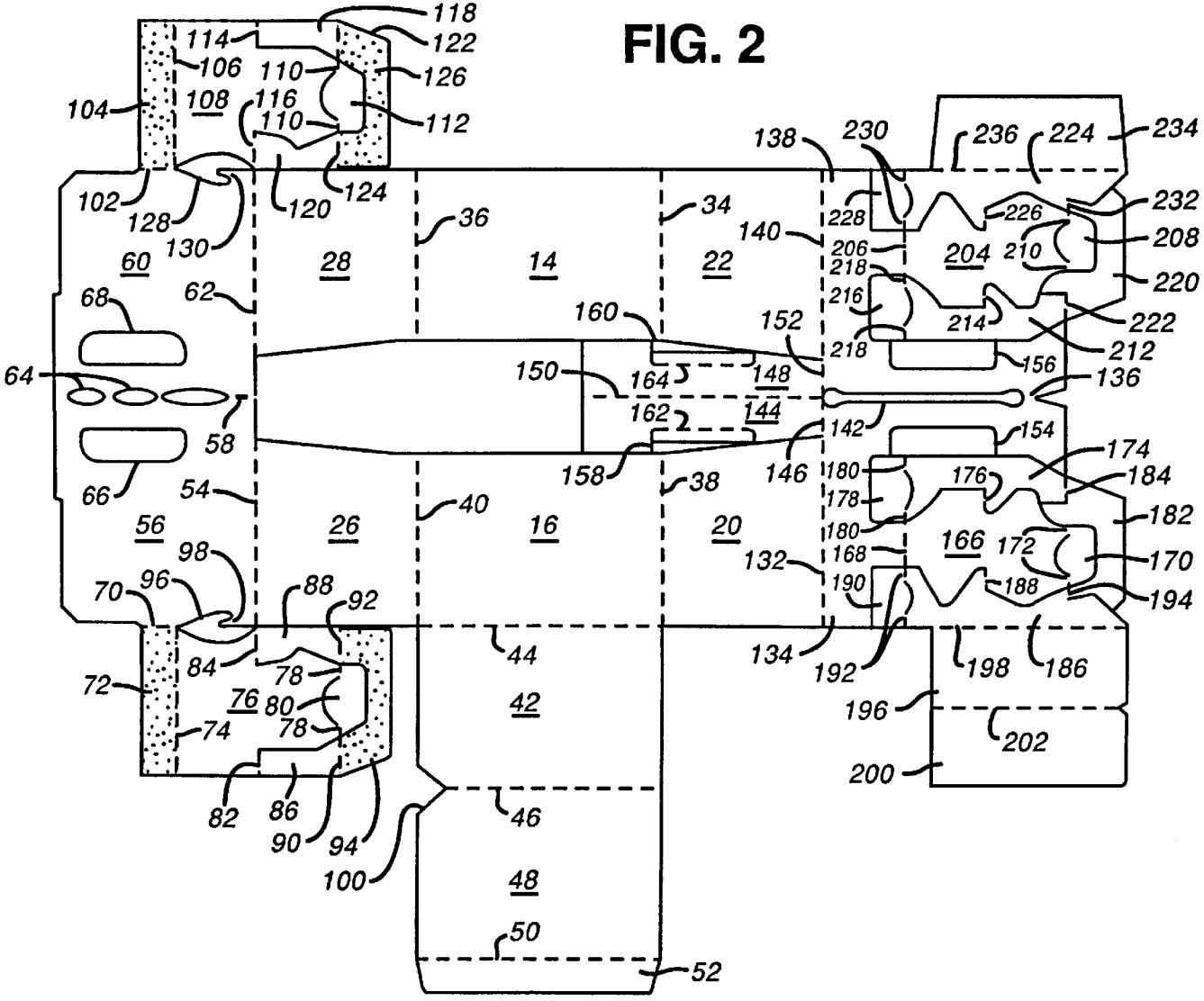
FIG. 2 is a plan view of a blank from which the carrier of FIG. 1 may be formed.

A blank from which the carrier 10 may be formed is shown in FIG. 2, the blank being shown with the inner surface visible. Side wall 14 is connected to end panel 22 along a fold line 34, and at an opposite end to end panel 28 along a fold line 36. Side wall 16 is connected at one end to end panel 20 along a fold line 38, and at an opposite end to end panel 26 along a fold line 40. Side wall 16 is also connected to primary bottom wall panel 42 along a fold line 44. Panel 42 is in turn connected along fold line 46 to primary bottom wall panel 48. Panel 48 is in turn connected along fold line 50 to a glue flap 52.

End panel 26 is connected along a fold line 54 to a medial panel 56. Medial panel 56 is connected along fold line 58 to a medial panel 60. Panel 60 is also connected to end panel 28 along a fold line 62. Fold line 58 includes a plurality of cutouts 64. Such cutouts 64 are included for relieving the accumulation of folded material during the folding and gluing of the blank, as is typical in the art. Additionally, medial panels 56 and 60 include openings 66 and 68, respectively, such openings cooperating to form a portion of the carton handle.

Connected along a fold line 70 at the lower end of medial panel 56 is an attachment panel 72. Attachment panel 72 is connected by fold line 74 to a secondary partition panel 76. Partition panel 76 includes fold lines 78 which connect the outer end of partition panel 76 to an anchoring flap 80. Also, partition panel 76 is connected by fold lines 82 and 84 to primary partition straps 86 and 88, respectively. Straps 86 and 88 are connected by fold lines 90 and 92, respectively, to an anchoring flap 94.

Formed between secondary partition panel 76 and medial panel 56 is an aperture 96 that defines along the edge of medial panel 56 a hook 98 used for temporarily retaining the carrier in an erected position during bottle loading. Such a hook structure is well known in the art, and cooperates with a notch 100 formed in bottom wall panels 42 and 48.

An alternate hook structure wherein a hook having two retention tabs is disposed along the erected medial panel intermediate its ends, and cooperates with an aperture formed in the bottom wall panels, may be seen by reference to co-pending, concurrently filed U.S. patent application Ser. No. (D-2868). Such disclosure is herein incorporated by reference.

Connected along a fold line 102 at the lower end of medial panel 60 is an attachment panel 104. Attachment panel 104 is connected by fold line 106 to a secondary partition panel 108. Partition panel 108 includes fold lines 110 which connect the outer end of partition panel 108 to an anchoring flap 112. Also, partition panel 108 is connected by fold lines 114 and 116 to primary partition straps 118 and 120, respectively. Straps 118 and 120 are connected by fold lines 122 and 124, respectively, to an anchoring flap 126.

Formed between secondary partition panel 108 and medial panel 60 is an aperture 128 that defines along the edge of medial panel 60 a hook 130 used in cooperation with hook 98 and notch 100 for temporarily retaining the carrier in an erected position during bottle loading.

End panel 20 is connected along the fold line 132 to partial medial panel 134. Partial medial panel 134 is in turn connected along a fold line 136 to partial medial panel 138, which is also connected along fold line 140 to end panel 22. Disposed between partial medial panels 134 and 138 is a relief aperture 142 for relieving material during the folding of the blank into the completed carrier.

Also connected to partial medial panel 134 is outer handle panel 144, connected along fold line 146. Outer handle panel 144 is connected to a second outer handle panel 148 along fold line 150. Outer handle panel 148 is also connected to partial medial panel 138 along fold line 152. Outer handle panels 144 and 148 are disposed generally between, but are separated from, end panels 20 and 22.

Partial medial panels 134 and 138 are provided with apertures 154 and 156, respectively, which form a part of the handle for the completed carrier. Handle panels 144 and 148 are also provided with apertures 158 and 160, which form a portion of the handle, and further include cushioning flaps 162 and 164, respectively, which extend partially into the apertures 158 and 160, respectively, to cushion the hand of a person carrying the carrier by the handle.

A secondary partition panel 166 is connected to partial medial panel 134 along fold line 168. An anchoring flap 170 is connected at the opposite end of secondary partition panel 166 by fold lines 172. An upper primary partition strap 174 is connected to secondary partition panel 166 along fold line 176. Strap 174 includes an anchoring flap 178 connected at one end along fold lines 180, and an anchoring panel 182 connected at an opposite end along fold line 184. A lower primary partition strap 186 is also connected to secondary partition panel 166 along fold line 188. Anchoring flap 190 is connected to strap 186 along fold lines 192, while the opposite end of strap 186 is connected to anchoring panel 182 along fold line 194.

A secondary bottom panel 196 is connected to the lower edge of primary partition strap 186 along fold line 198. Secondary bottom panel 200 is connected to bottom panel 196 along fold line 202.

A secondary partition panel 204 is connected to partial medial panel 138 along fold line 206. An anchoring flap 208 is connected at the opposite end of secondary partition panel 204 by fold lines 210. An upper primary partition strap 212 is connected to secondary partition panel 204 along fold line 214. Strap 212 includes an anchoring flap 216 connected at one end along fold lines 218, and an anchoring panel 220 connected at an opposite end along fold line 222. A lower primary partition strap 224 is also connected to secondary partition panel 204 along fold line 226. Anchoring flap 228 is connected to strap 226 along fold lines 230, while the opposite end of strap 226 is connected to anchoring panel 220 along fold line 232.

A secondary bottom panel 234 is connected to the lower edge of primary partition strap 224 along fold line 236.

Figure 3:
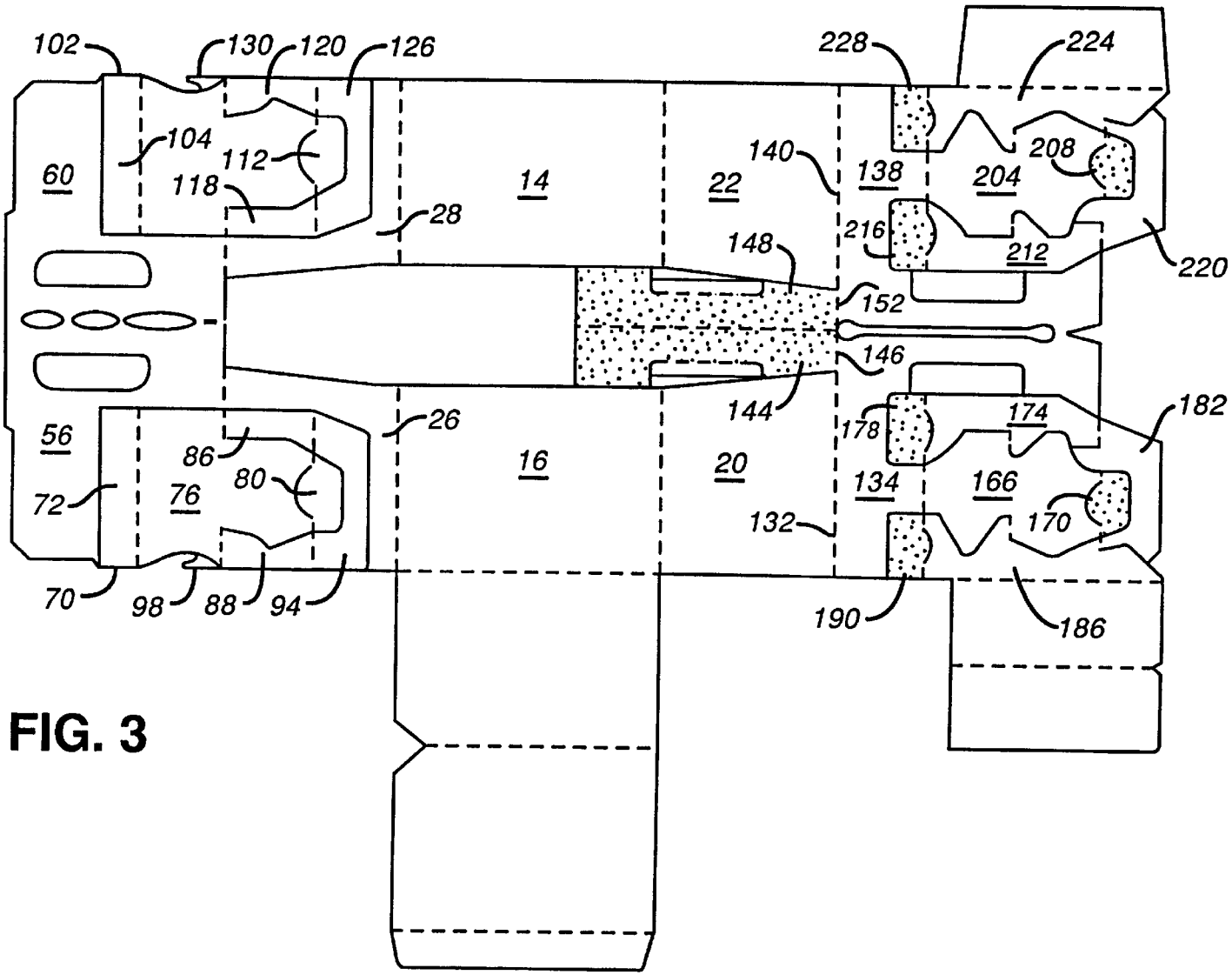
FIGS. 3–6 are a series of views showing the manner in which the blank of FIG. 2 may be folded to form the completed collapsed carrier.

To assemble the blank of FIG. 2 into the completed, collapsed carrier, glue is first applied to attachment panels 72 and 104 and anchoring flaps 94 and 126 as shown generally by cross hatching in FIG. 2. Attachment panel 72, secondary partition panel 76, straps 86 and 88 and anchoring flap 94 are then rotated along fold line 70 and positioned on medial panel 56 and end panel 26, as shown in FIG. 3. As a result of the glue which has been applied, attachment panel 72 is secured to medial panel 56, and anchoring flap 94 is secured to end panel 26.

Similarly, attachment panel 104, secondary partition panel 108, straps 118 and 120 and anchoring flap 126 are all pivoted about fold line 102 and placed in position on medial panel 60 and end panel 28 as shown in FIG. 3. Attachment panel 104 is thereby secured to medial panel 60, and anchoring flap 126 is secured to end panel 28.

Figure 4:
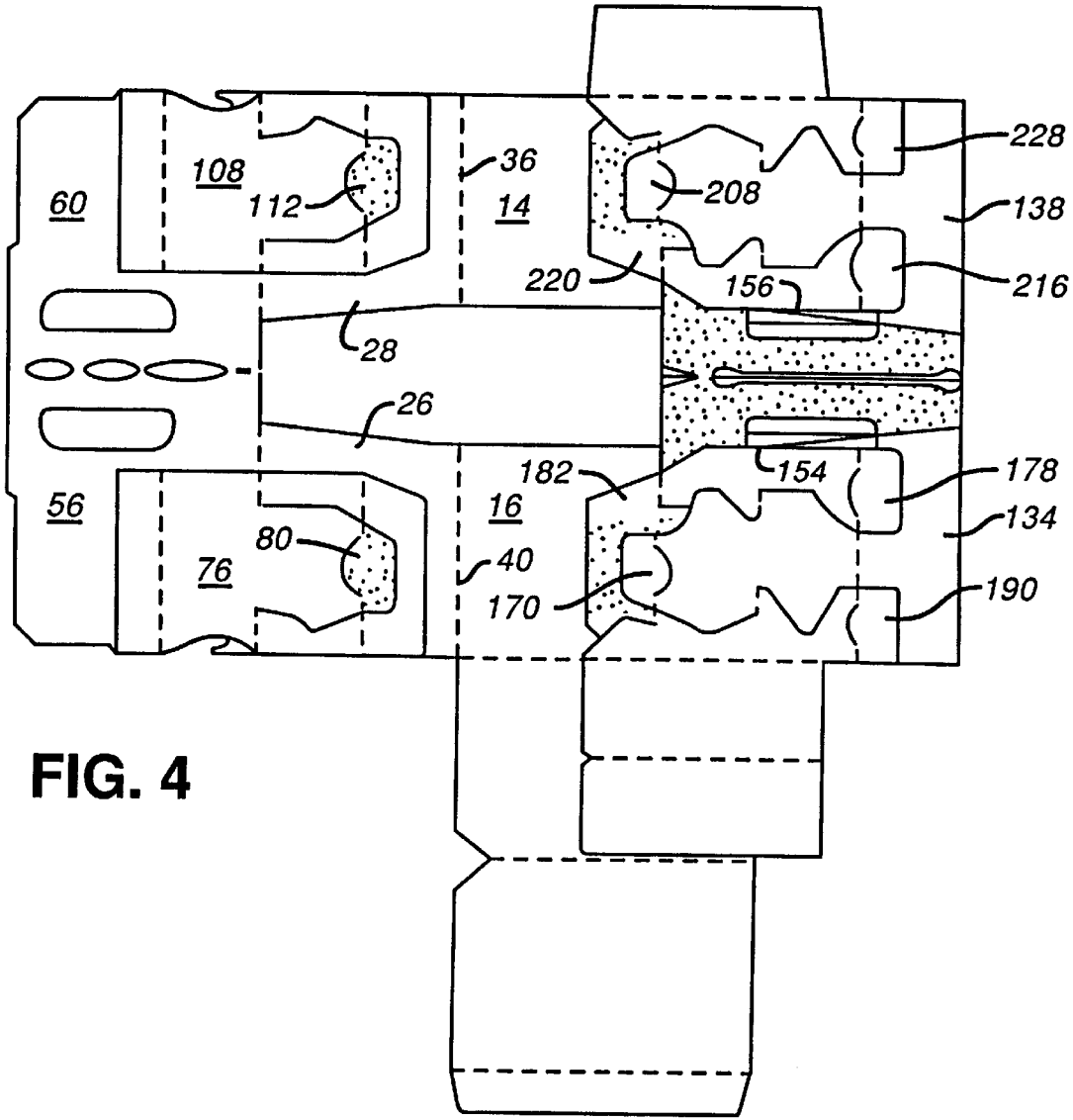

Continuing to refer to FIG. 3, glue is next applied to outer handle panels 144 and 148, and to anchoring flaps 170, 178, 190, 208, 216 and 228. The right hand portion of the blank as shown in FIG. 3, including partial medial panels 134 and 138, is pivoted about fold lines 132, 146, 152 and 140. The folded portion of the blank is then generally positioned on end panels 20 and 22 and partially on side panels 14 and 16, as shown in FIG. 4. Because of the glue previously applied, anchoring panel 170 is secured to side panel 16, anchoring panels 178 and 190 are secured to end panel 20, anchoring flap 208 is secured to side panel 14, and anchoring flaps 216 and 228 are secured to end panel 22.

For the next step in the folding and gluing of the blank, glue is applied to anchoring flaps 80 and 112 as shown in FIG. 4. Additionally, glue is applied to a portion of anchoring panels 182 and 220, and to partial medial panels 134 and 138 in the vicinity of apertures 154 and 156. After the application of glue, the left hand portion of the blank as shown in FIG. 4 is folded along fold lines 36 and 40, thereby folding end panels 26 and 28 and medial panels 56 and 60 into overlapping relationship with side panels 14 and 16 and partial medial panels 134 and 138. As a result of the glue previously applied, anchoring flap 80 is secured to side panel 16, while anchoring flap 112 is secured to side panel 14. Anchoring panel 182 is secured to a portion of secondary partition panel 76, and anchoring panel 220 is secured to a portion of secondary partition panel 108. Additionally, medial panels 56 and 60 are secured to partial medial panels 134 and 138, respectively. The partially completed carrier then appears as shown in FIG. 5.

Figure 5:
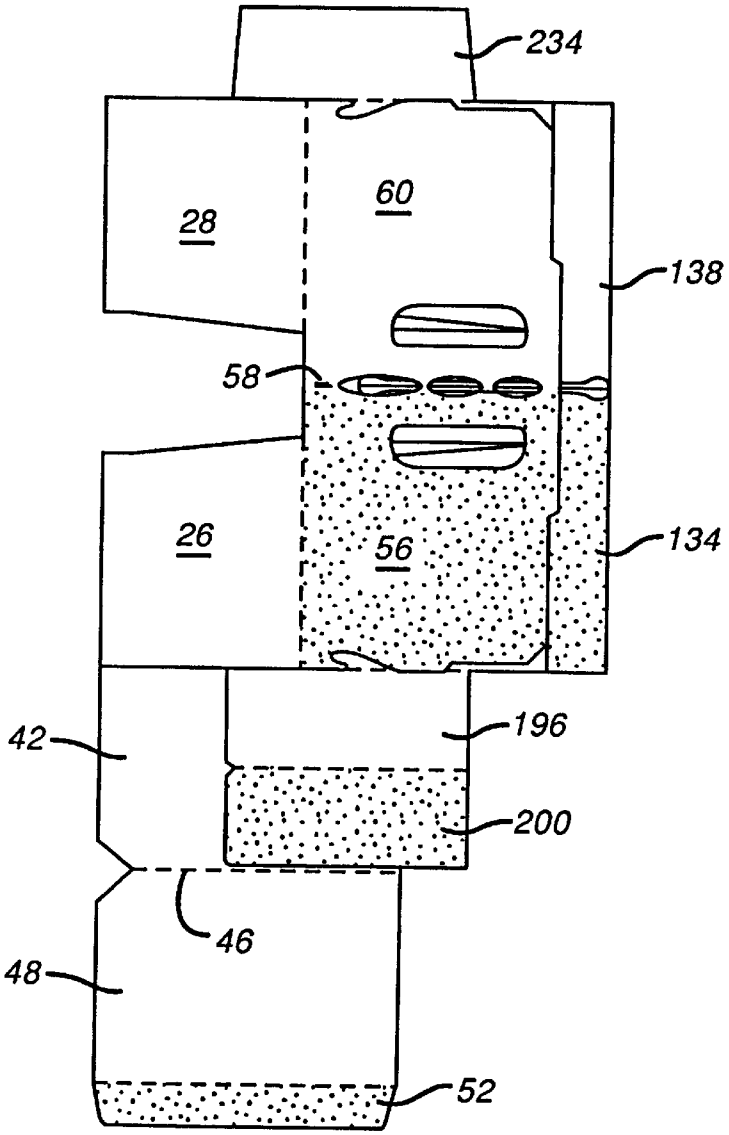

As the final step in the gluing and folding process, glue is applied as shown in FIG. 5 to medial panel 56 and partial medial panel 134. Glue is also applied to secondary bottom panel 200 and glue flap 52. The upper portion of the partially completed carton shown in FIG. 5 is then folded along fold line 58 to secure medial panel 60 to medial panel 56 and partial medial panel 138 to partial medial panel 134. Secondary bottom panel 200 is then folded along fold line 202 to secure bottom panel 200 to secondary bottom panel 234. Finally, primary bottom panel 48 is folded along fold line 46 to secure glue flap 52 to the outer surface of side panel 14.

Figure 6:
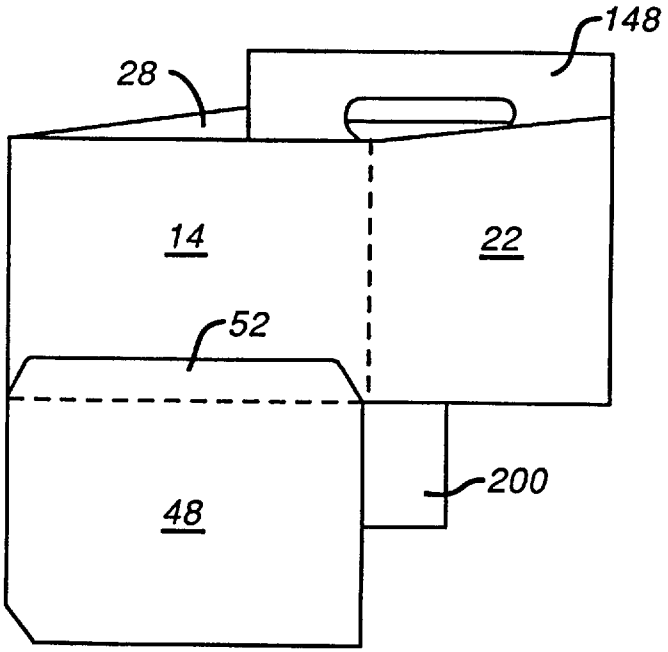

The completed and collapsed carton is shown in FIG. 6.

Figure 7:
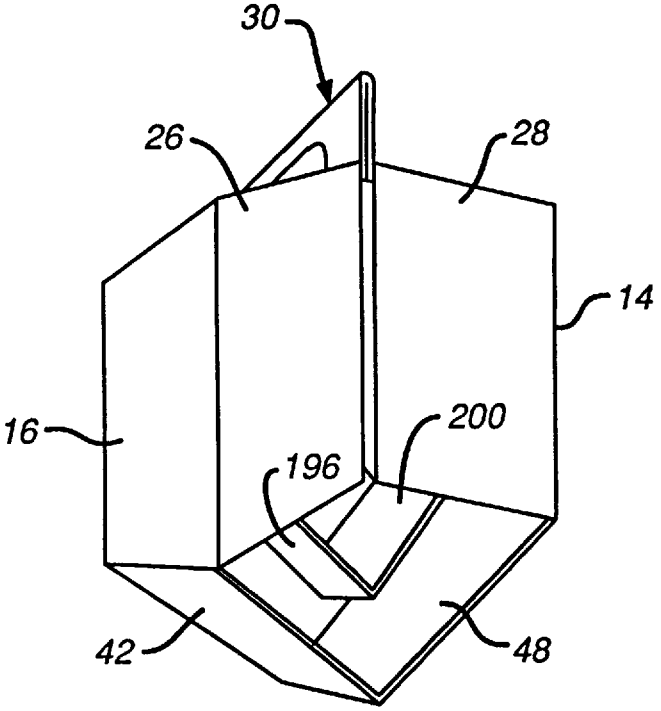
FIG. 7 is a perspective view of the carrier shown in an intermediate position during set up from a collapsed to erected carrier.

The carton may be erected as shown in FIG. 7. Side walls 14 and 16 are moved longitudinally with respect to the medial panel structure 30. As a result, end panels 20, 22, 26 and 28 are moved into position to form the end walls 18 and 24 as shown in FIG. 1. Such a method of erecting is typical of basket-style carriers of the prior art.

As shown in FIG. 7, however, the carrier of the present invention forms a double bottom structure. A primary bottom wall is formed from primary bottom panels 42 and 48, connected to side walls 14 and 16. Panels 42 and 48 move into a planar relationship as the carton is erected, thereby forming the primary bottom wall.

In a similar manner, the secondary bottom wall is formed from secondary bottom panels 196 and 200. These panels are connected to the primary partition structure (refer back, for example, to FIG. 2). Set up of the carrier causes panels 196 and 200 to move into a planar position, thereby creating a secondary bottom wall which extends between the primary partition structures. As a result, bottles or other articles which are loaded into the carton into the outermost rows will be positioned only on the primary bottom wall, on one of the panels 42 and 48. Bottles or other articles positioned on the innermost two rows will be supported by a double-ply bottom structure, and will be disposed on either panel 196 or 200, which will in turn be positioned in contact with panel 42 or 48, respectively.

Figure 8:
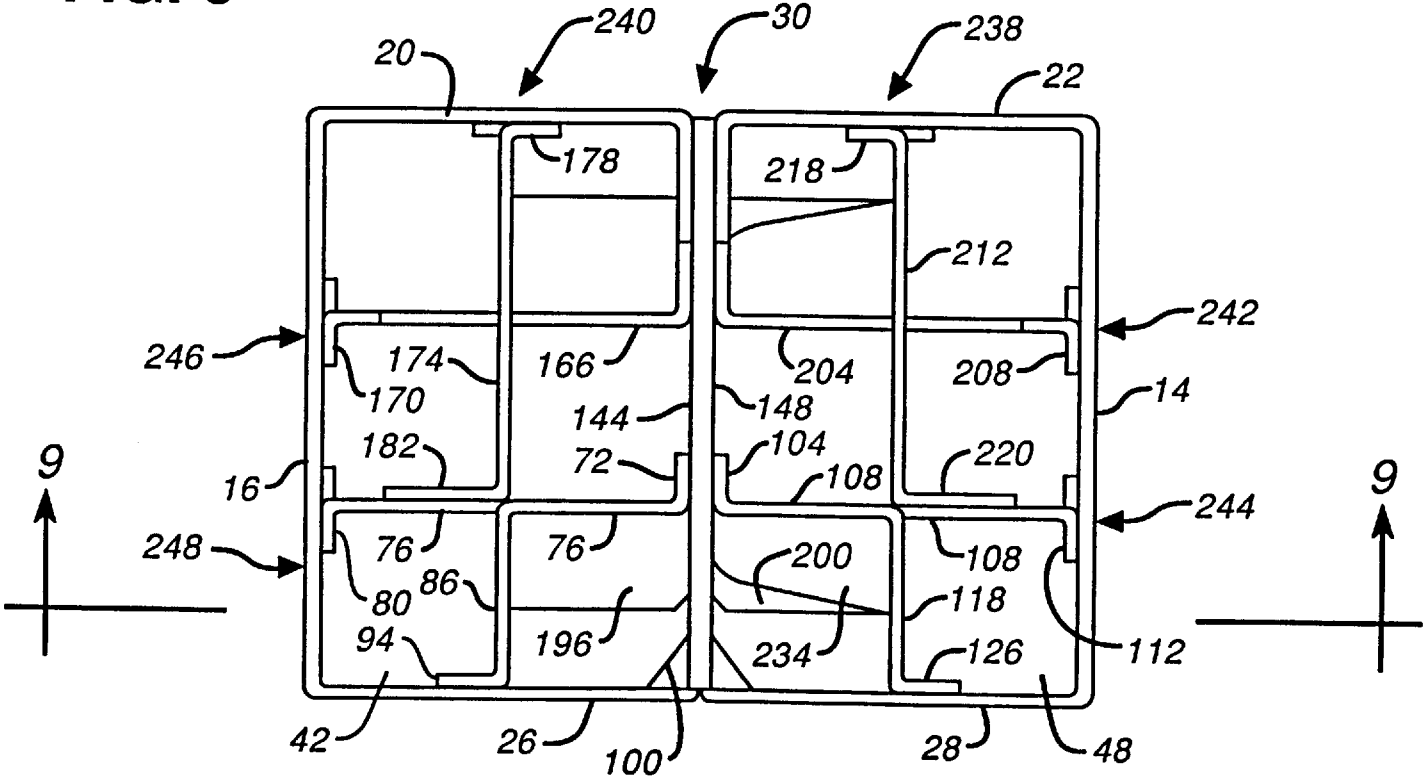
FIG. 8 is a top plan view of the carrier of FIG. 1, shown with the articles removed.

Further reference may be made to FIG. 8, which shows the erected carrier in top plan view. From FIG. 8, it can be seen that the first primary partition structure 238 is positioned between side wall 14 and medial panel structure 30, and is comprised of strap 212 (and strap 224, not shown) and strap 120 (and strap 118, not shown). A second primary partition structure 240 is disposed between medial panel structure 30 and side wall 16, and comprises strap 174 (and strap 186, not shown) and strap 86 (and strap 88, not shown). Secondary partition structure 242, comprised of secondary partition panel 204 and secondary partition structure 244, comprised of secondary partition panel 108, interconnects side wall 14, primary partition structure 238, and medial panel structure 30. Secondary partition structure 246, comprised of secondary partition panel 166, and secondary partition structure 248, comprised of secondary partition panel 76, interconnects side wall 16, primary partition structure 240 and medial partition structure 30. The primary and secondary partition structures together define a plurality of cells for receiving the bottles or other articles to be packaged within the carrier.

Figure 9:
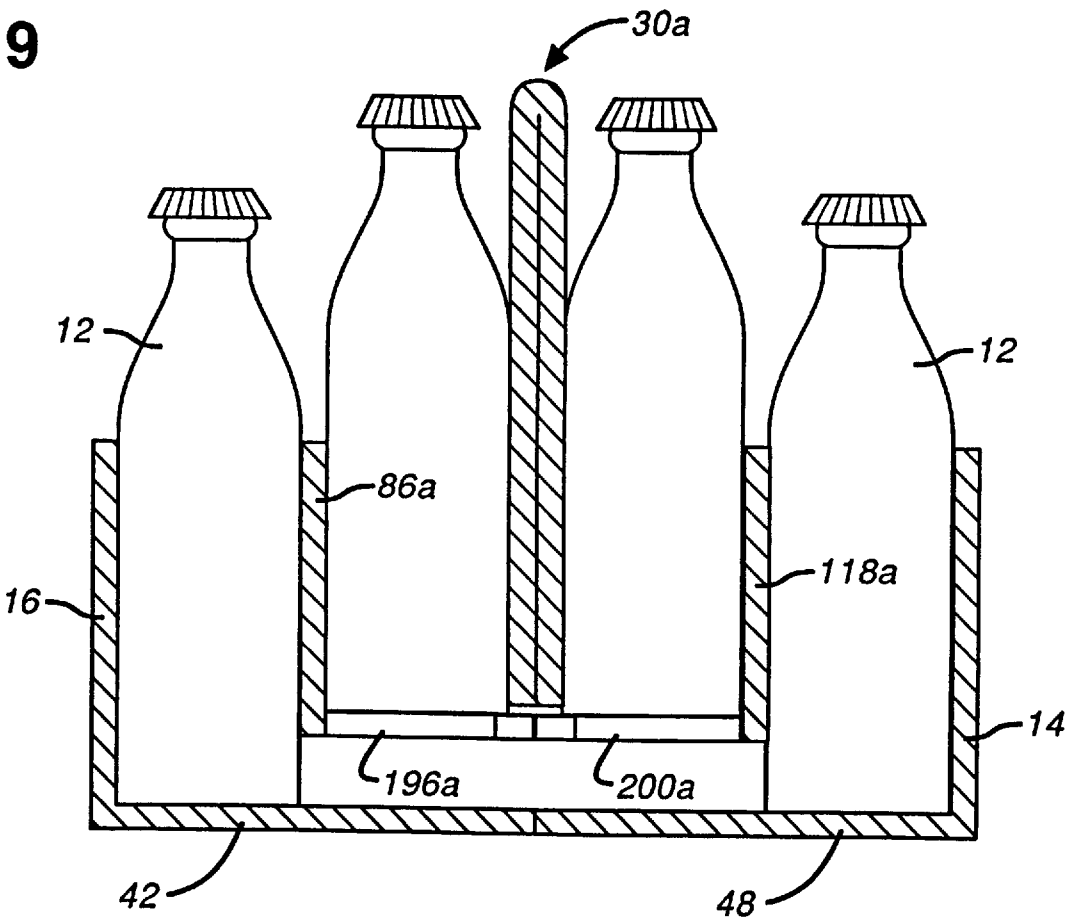
FIG. 9 is a sectional view of a carrier in accordance with an alternate embodiment of the present invention, taken along the line 9—9 in FIG. 8.

A number of variations may be made to the preferred embodiment as described herein. For instance, the primary partition structure could have a height which is less than that of the side and end walls. An example of such a carrier can be seen in FIG. 9. In such a case, the secondary bottom wall 196*a*, 200*a* could be positioned somewhat above the primary bottom wall 42, 48. As a result, the bottles held within the innermost rows would be presented in a raised, tiered configuration with respect to the outermost bottles.

Other variations, such as providing full height end and side walls, could be made using techniques generally known in the art.

Still other variations will be readily apparent to those skilled in the art from the foregoing description of the preferred embodiment, the accompanying drawings and the appended claims.

What is claimed is:

1. A carrier for a plurality of objects arranged in four rows, comprising:

substantially parallel first and second side walls;

substantially parallel first and second end walls interconnecting said side walls;

a medial panel extending between and connected to said first and second end walls, said medial panel being disposed between and substantially parallel to said first and second side walls;

first primary partition structure extending between and connected to said first and second end walls, said first primary partition structure being disposed between and substantially parallel to said first side wall and said medial panel;

second primary partition structure extending between and connected to said first and second end walls, said second primary partition structure being disposed between and substantially parallel to said second side wall and said medial panel;

a primary bottom wall connected and extending between lower portions of said first and second side walls; and a secondary bottom wall connected and extending between lower portions of said first and second primary partition structures.

2. A carrier as defined in claim 1, further comprising secondary partition structure extending between and connected to said first side wall and said first primary partition structure, said first primary partition structure and said medial panel, said medial panel and said second primary partition structure, and said second primary partition structure and said second side wall to define therewith a plurality of cells for receiving the objects.

3. A carrier as defined in claim 1, wherein said primary and secondary bottom walls are disposed in substantially face-to-face contact.

4. A carrier as defined in claim 1, wherein said secondary bottom wall is disposed in a spaced relationship above said primary bottom wall.

* * * * *